US008241187B2

(12) United States Patent
Moon et al.

(10) Patent No.: US 8,241,187 B2
(45) Date of Patent: Aug. 14, 2012

(54) POWER ASSISTED ARM DRIVEN TREADMILL

(75) Inventors: Dan Moon, Riverside, IL (US); Frank Trulaske, St. Louis, MO (US); Stan Goldfader, St. Louis, MO (US)

(73) Assignee: True Fitness Technology, Inc., O'Fallon, MO (US)

( * ) Notice: Subject to any disclaimer, the term of this patent is extended or adjusted under 35 U.S.C. 154(b) by 932 days.

(21) Appl. No.: 11/234,614

(22) Filed: Sep. 23, 2005

(65) Prior Publication Data

US 2006/0068978 A1 Mar. 30, 2006

Related U.S. Application Data

(60) Provisional application No. 60/613,661, filed on Sep. 28, 2004.

(51) Int. Cl.
*A63B 22/02* (2006.01)

(52) U.S. Cl. ..... 482/54; 482/1

(58) Field of Classification Search ..... 482/1–9, 482/54, 70, 71

See application file for complete search history.

(56) References Cited

U.S. PATENT DOCUMENTS

| | | | | |
|---|---|---|---|---|
| 1,211,765 | A | | 1/1917 | Schmidt |
| 3,216,722 | A | | 11/1965 | Odom |
| 4,188,030 | A | | 2/1980 | Hooper |
| 4,313,603 | A | | 2/1982 | Simijan |
| 4,512,571 | A | | 4/1985 | Hermelin |
| 4,529,195 | A | | 7/1985 | Stevens |
| 4,602,779 | A | * | 7/1986 | Ogden ..... 482/54 |
| 4,632,385 | A | | 12/1986 | Geraci |
| 4,712,790 | A | | 12/1987 | Szymski |
| 4,869,494 | A | | 9/1989 | Lambert, Sr. |
| 4,880,225 | A | | 11/1989 | Lucas et al. |
| 4,911,425 | A | | 3/1990 | Kynast et al. |
| 4,960,276 | A | | 10/1990 | Feuer et al. |
| 4,966,362 | A | | 10/1990 | Ramaekers |
| 4,979,731 | A | | 12/1990 | Hermelin |
| 4,986,533 | A | | 1/1991 | Lo |
| 5,058,888 | A | | 10/1991 | Walker et al. |
| 5,110,117 | A | | 5/1992 | Fisher et al. |
| 5,192,257 | A | | 3/1993 | Panasewicz |
| 5,209,715 | A | | 5/1993 | Walker et al. |
| 5,226,866 | A | | 7/1993 | Engel et al. |
| RE34,478 | E | | 12/1993 | Dalebout |
| 5,318,491 | A | | 6/1994 | Houston |
| 5,403,255 | A | | 4/1995 | Johnston |
| 5,411,455 | A | | 5/1995 | Haber et al. |
| 5,447,479 | A | | 9/1995 | Gvoich |
| 5,462,504 | A | | 10/1995 | Trulaske et al. |

(Continued)

FOREIGN PATENT DOCUMENTS

| | | |
|---|---|---|
| CA | 966865 | 4/1975 |

(Continued)

*Primary Examiner* — Loan Thanh
*Assistant Examiner* — Shila Jalalzadeh Abyane
(74) *Attorney, Agent, or Firm* — Lewis, Rice & Fingersh, L.C.

(57) ABSTRACT

Systems and methods for a treadmill or similar exercise device which utilizes a principally arm driven belt, but includes a motor assist which provides for additional drive to the belt. The motor assist device may constructively or destructively interact with the user provided motive force via the arms. Generally, the motor will allow for the device to utilize incline as well as to make the device easier to start from rest.

36 Claims, 7 Drawing Sheets

U.S. PATENT DOCUMENTS 5,664,636 A * 9/1997 Ikuma et al. ..... 180/206
5,688,209 A 11/1997 Trulaske et al.
5,871,421 A * 2/1999 Trulaske et al. ..... 482/54
6,033,344 A * 3/2000 Trulaske et al. ..... 482/7
6,955,630 B2 * 10/2005 Sher ..... 482/8
RE39,180 E * 7/2006 Colassi ..... 482/54
2003/0134714 A1 * 7/2003 Oishi et al. ..... 482/6
2004/0209738 A1 * 10/2004 Crawford et al. ..... 482/8

FOREIGN PATENT DOCUMENTS

JP 2003231491 A * 8/2003
TW 235488 12/1994

* cited by examiner

POWER ASSISTED ARM DRIVEN TREADMILL

CROSS REFERENCE TO RELATED APPLICATION(S)

This Application claims the benefit of U.S. Provisional Patent Application Ser. No. 60/613,661 filed Sep. 28, 2004, the entire disclosure of which is herein incorporated by reference.

BACKGROUND

1. Field of the Invention

This disclosure relates to exercise devices, such as treadmills, particularly to treadmills which utilize a motor and arm movement of a user together to drive the belt.

2. Description of the Related Art

Conventional treadmills operate by employing a motor to rearwardly drive an endless belt upon which the user runs, walks, or otherwise engages in ambulatory leg movment, generally in a direction opposing the motion of the belt. As the user is moving in opposition to the belt, the user therefore exercises in order to remain in place. Generally, a user of a conventional treadmill is able to vary the speed and incline of the treadmill to obtain a desired level of workout by increasing the speed of the motor to accelerate the speed of the belt and increase their necessary movement speed. Alternatively, the user can make the workout more difficult by increasing the incline to simulate moving uphill. More sophisticated motorized treadmills, such as those described in U.S. Pat. No. 5,462,504, the entire disclosure of which is herein incorporated by reference, automatically adjust the speed and incline of the treadmill to control the heart rate of the user during the exercise.

Conventional treadmills of this type function to exercise the user's cardiovascular system and the skeletal muscles of the lower body, but do not exercise the upper body to any significant extent. However, a number of treadmills have been constructed which have upper body exercise devices associated therewith. These upper body exercise systems are traditionally arm members which are independently moveable against the resistance of a spring or friction plate in a swinging motion, to provide for an upper body workout in conjunction with the cardiovascular and lower body workout while still providing a fairly natural movement.

There are also simple treadmills which do not use motors to supply the belt's rotary motion, but instead rely on the user of the treadmill to provide their own motion which is imparted to the belt. These devices have a clear advantage over motorized units in being significantly lighter than their motorized counterparts, and generally much less expensive to produce. To allow for continuous, in-place, motion, non-powered or "motorless" treadmills traditionally were designed to support the endless belt on an incline such that the belt rotates rearwardly as a result of the weight and forward stride of the user overcoming belt friction. However, once the incline is set, these types of treadmills can feel unnatural to a user because changes to the belt speed depend only upon the amount of additional rearward force a user is able to apply. A faster running movement is unlike actual running as the stride must be changed to impart sufficient force to the belt to generate the speed of the belt necessary for the running movement as it is not supplied externally by the motor. For example, without interrupting an exercise session to adjust the incline, a user wishing to increase the speed of a gravity-driven belt must push down and/or forwardly on hand rails or arm members in order to change the amount of rearward force applied to the belt. Such a motion is not a natural change to a person's stride when increasing speed.

Further, traditional motorless treadmills cannot effectively use both incline and speed to independently alter exercise characteristics because the weight of the user, incline and speed are all related. Therefore, when the incline is increased, the speed also increases. While in some cases this may be desirable, in many cases it is not. In particular, many desirable cardiovascular workouts use periods of walking on high inclines followed by periods of running on low inclines. This type of exercise cannot be performed on traditional motorless treadmills because as the incline is increased, the user necessarily must move faster based on the design of the machine.

U.S. Pat. Nos. 5,688,209 and 5,871,421, the entire disclosures of which are herein incorporated by reference, describe motorless treadmills which allow the user to supplement the motion of the belt with the motion of their arms to eliminate or reduce some of the issues of being unable to control speed and incline separately. These treadmills provide both an upper and lower body workout as they provide for upper body power being transferred to the rotation of the belt. These treadmills also help to eliminate the need to use unnatural motions to produce different speeds which improves the natural feeling of the exercise motion and helps to provide separate control over incline and speed. If a user wishes to go faster, they can increase the speed of the belt by increasing the rate (or power) applied to the arm members which accelerates the belt without the user having to alter their stride in an unnatural fashion or stop the exercise and alter the incline of the belt.

While these devices are an improvement over what was previously available as they allow for, among other things, less incline for similar speed which allows for a generally more normal gait, they still have a noticeable problem. In order to prevent the user from having to alter their stride unnaturally to accelerate the belt beyond a speed easily obtained by a preset incline, the user is required to pump the arm members harder and faster. For many users, this is not a problem, and provides for a natural motion because as they increase in running speed, their arms naturally reciprocate faster to balance. For some, however, particularly those with less upper body strength, the acceleration's necessarily increased demand on the upper body can be undesirable. Because of the reliance on the limits of propulsive force of the upper extremities and the requirements of most users, the belt speed may again become dependent on the user's rearward force.

This problem is still further exaggerated when the treadmill is at a low angle of incline, the user's weight is pressing the belt into the platform over which it is supported and little of the user's weight serves to help move the belt as it would if the belt was at a higher incline, therefore there is a much greater frictional and inertial component which must be overcome to move the belt than when the belt is at a steeper incline. Further, generally a user will wish to start exercising with the belt at a low angle of incline and with a slower speed as that is generally considered a less rigorous exercise and provides for a warm-up period.

The inertial component at the start of the exercise and the need for increased arm drive and upper body workout to increase speed are one of the concerns with an arm driven motorless treadmill. Another is that the steeper the incline of the treadmill and the heavier the user, the easier it is to move the belt. This, sometimes, can create problems where the exercise is undesirably fast. Many modern users like to increase incline as a way of making the exercise more difficult without necessarily having to run on the treadmill. With a motorless arm powered treadmill, however, for some individuals the belt can actually move too easily when the platform is greatly inclined forcing the user to have to run to keep up with the change in incline when they would prefer to move slower at the higher incline. For a heavier individual, the belt can be acted upon by significant force just from the weight of the individual which can result in the user needing to run at an undesirably high speed to keep from falling off the treadmill. Therefore, at a high incline, the user may also be moving faster than desired during the exercise.

SUMMARY

Because of these and other problems in the art, discussed herein are motor assisted arm-driven treadmills or similar exercise devices which utilize a principally arm driven belt, but includes a motor assist to provides for additional drive to the belt. The motor assist device may constructively or destructively interact with the user provided motive force via the arms. Generally, the motor will allow for the device to utilize incline as well as to make the device easier to start from rest.

Motorless treadmills, therefore, generally have the problem that there is a certain minimum level of exercise that can be performed, and that minimum level, for some users, is undesirably high. This treadmill generally serves to provide for benefits over existing treadmills which are both motorless and motorized. With regards to motorized treadmills, because the motor is used to assist the user in driving the machine, and generally does not drive the machine on its own, a smaller motor can be used and the exercise benefits of arm driving can still be obtained. This also generally provides for a decrease in cost and weight with regards to the traditional motorized treadmill. With regards to a motorless treadmill, the treadmills described herein can provide for compensation for users wanting a workout which is not as strenuous on the upper body as would be required for a "pure" motorless arrangement, particularly at high speed and/or low inclines, and can also provide starting assistance to prevent straining at the start of the exercise. Further, in an embodiment, the motor can be used to actually work against the belt to provide for more comfortable motion when the treadmill is at a steep incline by providing braking to further decouple speed and incline from each other.

Described herein, among other things is a treadmill comprising: a frame; an endless belt supported on the frame; an arm member being displaceable forwardly and rearwardly relative to the frame by a reciprocating arm movement of a user; a drive roller coupled to the belt for imparting motion to the belt; a transmission system linking the drive roller to the displaceable arm member; and a motor assist device coupled to the endless belt, so that operation of the motor assist device will impart motion to the belt; wherein displacement of the arm members in combination with the operation of the motor assist device together impart motion to rotate the endless belt in a first direction.

In an embodiment of the treadmill, the motor assist device alone is incapable of imparting motion to the endless belt when a user is on the endless belt.

In an embodiment of the treadmill the arm member in combination with the operation of the motor assist device together actuate the endless belt to start rotation in the first direction from a stationary position. This may be because the motor assist device alone is incapable of actuating the endless belt to start rotation in the first direction from the stationary position when a user is on the endless belt.

In an embodiment of the treadmill the motor assist device comprises a motor having 1 or less horsepower and may comprise an electric motor. The motor assist device may comprise a part of the drive roller or drive the drive roller. The amount of motion imparted by the motor assist device may be altered during an exercise such as by selection the amount of motion based on a user's heart rate or by being preselected by a user prior to the exercise.

In an embodiment of the treadmill, the treadmill further comprisess a support surface, the endless belt passing over the support surface. The motor assist device is located under or in front of the support surface.

In an embodiment of the treadmill the treadmill further comprises a second arm member being displaceable forwardly and rearwardly relative to the frame by a reciprocating arm movement of a user, the second arm mechanism also being linked to the transmission system. The transmission system may include a pulley system which may include at least one drive pulley coupled to the drive roller for rotation thereof and at least one displaceable pulley coupled to one of the arm members for displacement thereby, and further comprising a cable connected between the pulleys such that displacement of the displaceable pulley is translated by the cable into rotation of the drive roller pulley. In another embodiment the treadmill further comprises a linkage connecting the arm members, such as by coupling the arm members for alternating, reciprocating movement.

In an embodiment of the treadmill the treadmill further comprises an elevation system for controllably adjusting the angle of inclination of the treadmill.

In an embodiment of the treadmill the arm transmission system comprises a secondary belt and additional roller, the arm member causing the secondary belt to rotate on the additional roller and the drive roller. The arm member may move in a substantially linear path.

In an embodiment of the treadmill the arm member rotates about a point. The treadmill may further comprise a computer control device which may display the amount of work performed by the upper body of a user.

In an embodiment the motor assist device can be used to approximate the weight or strength of a user.

The user may exercise on the treadmill by running, walking, or displacing the arm members while standing.

In an embodiment, there is discussed herein, a method of driving the rotation of a treadmill belt, comprising the steps of: inclining a front end of the belt such that gravitational force on a user frictionally coupled to the belt urges the belt rearwardly; transferring kinetic energy generated by arm movements of the user to rearward movement of the belt to assist the gravitationally induced rearward movement of the belt; and providing a motor assist device, the motor assist device mechanically assisting the gravitationally induced rearward movement of the belt independent of the assistance from the transferred kinetic energy. In another embodiment, of the method there may also be provided a drive roller connected to the belt for rearward rotation thereof; wherein in the step of transferring, the arm movements rotate a pulley which in turn rotates the drive roller rearwardly.

In an embodiment, there is described herein a treadmill comprising: a frame; an endless belt supported on the frame; an arm member being displaceable forwardly and rearwardly relative to the frame by a reciprocating arm movement of a user; a drive roller coupled to the belt for imparting motion to the belt; a transmission system linking the drive roller to the displaceable arm member; and a motor assist device coupled to the endless belt, so that operation of the motor assist device will impart motion to the belt; wherein displacement of the arm members in combination with the operation of the motor assist device together actuate the endless belt to start rotation in a first direction from a stationary position.

In another embodiment of the treadmill at a time after the endless belt has been actuated, the motor assist device and the displacement of the arm members work either constructively or destructively with each other to impart motion to the endless belt.

DETAILED DESCRIPTION OF PREFERRED EMBODIMENT(S)

Figure 1:
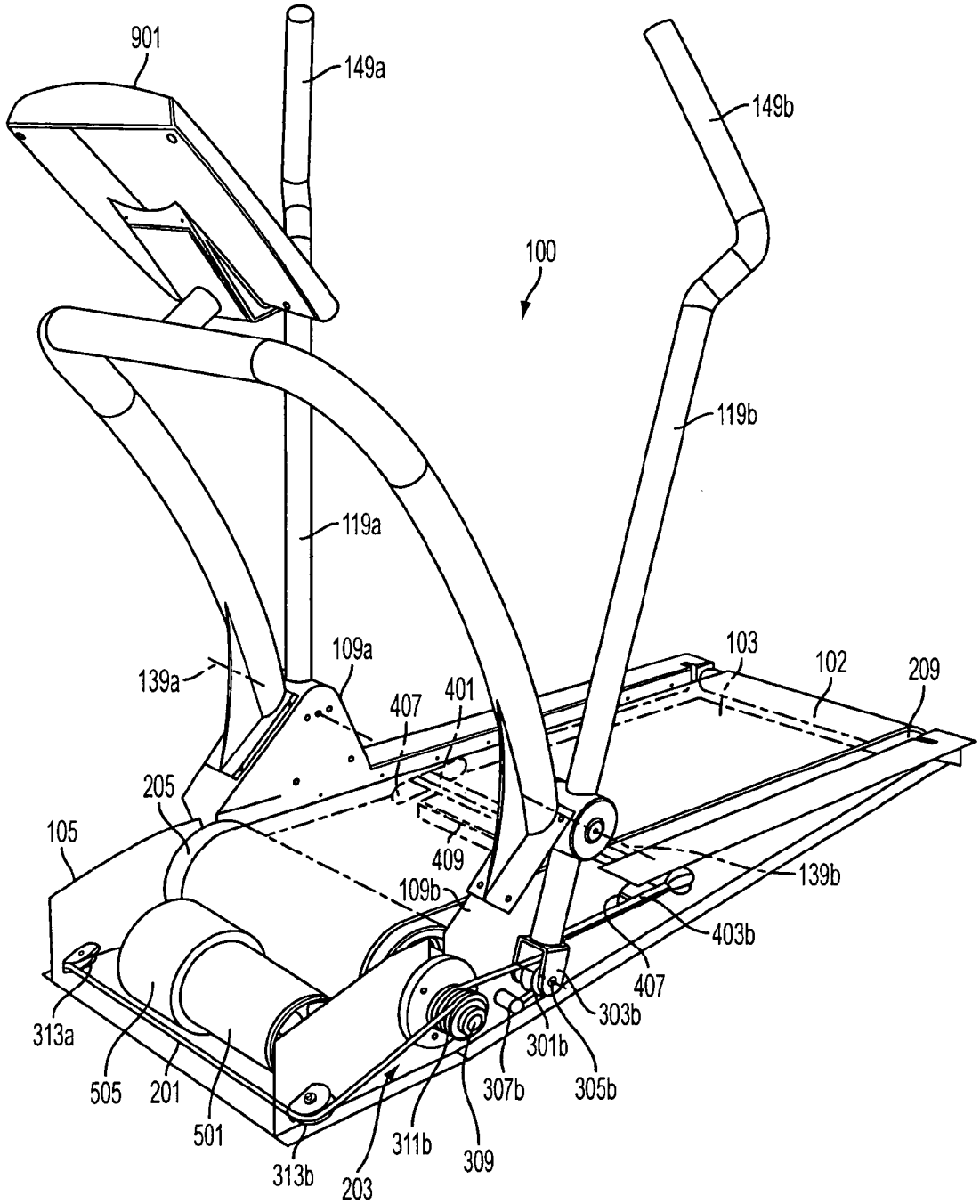
FIG. 1 is a front perspective view illustrating an embodiment of a treadmill having a dual arm arrangement and a motor assist located forward of the drive roller.
Figure 2:
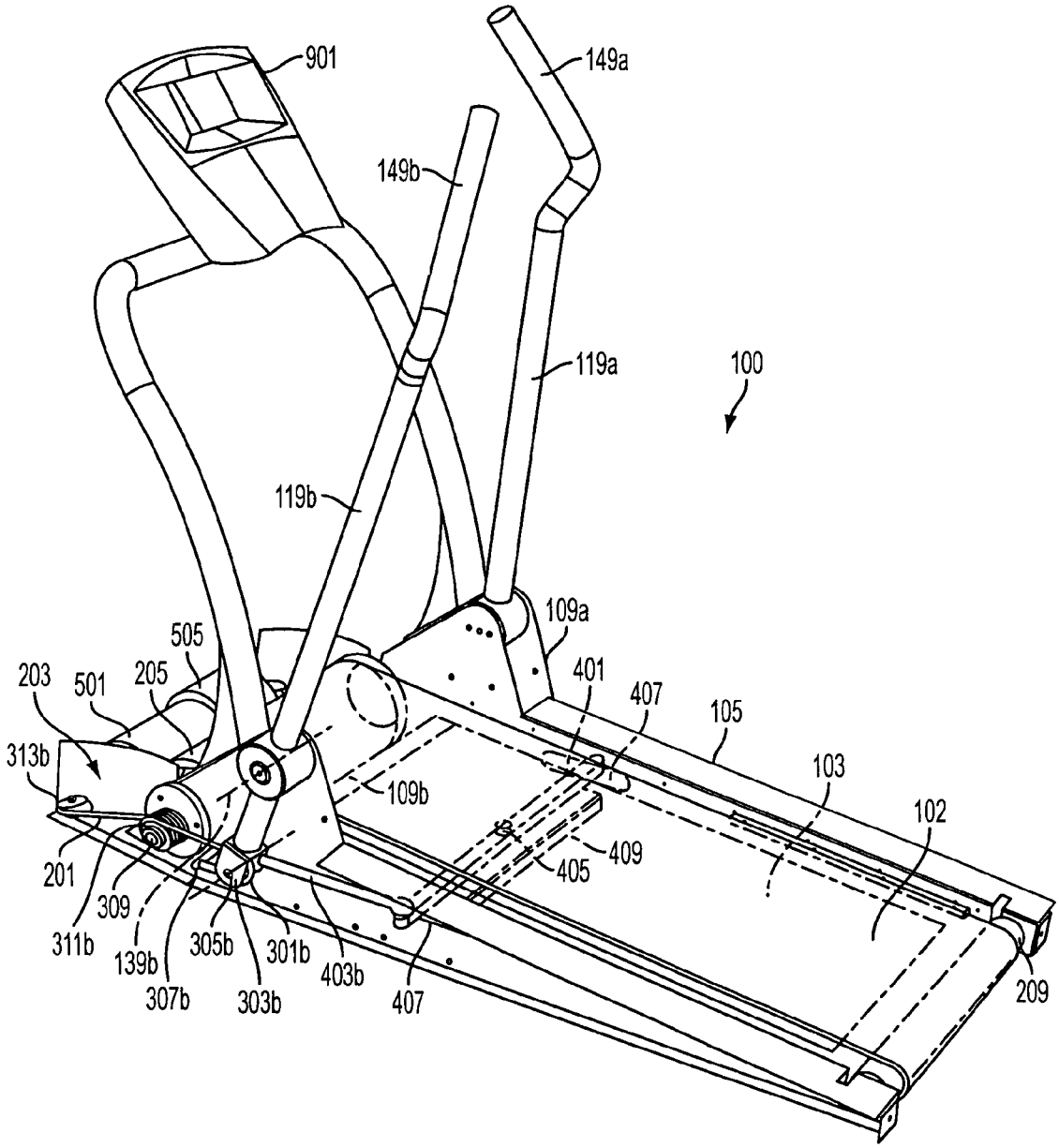
FIG. 2 is a side perspective view of the embodiment of FIG. 1.
Figure 3:
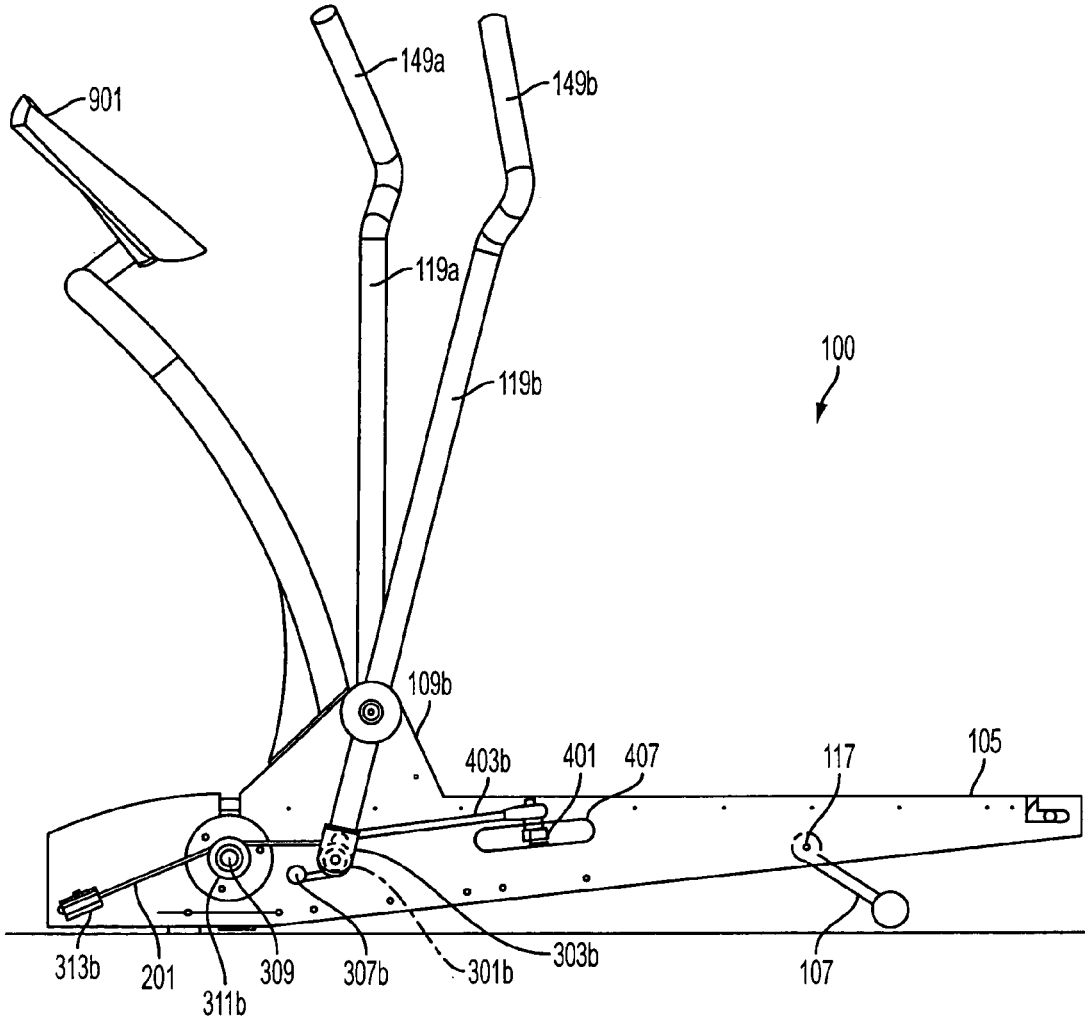
FIG. 3 is a side view of the embodiment of FIG. 1.
Figure 4:
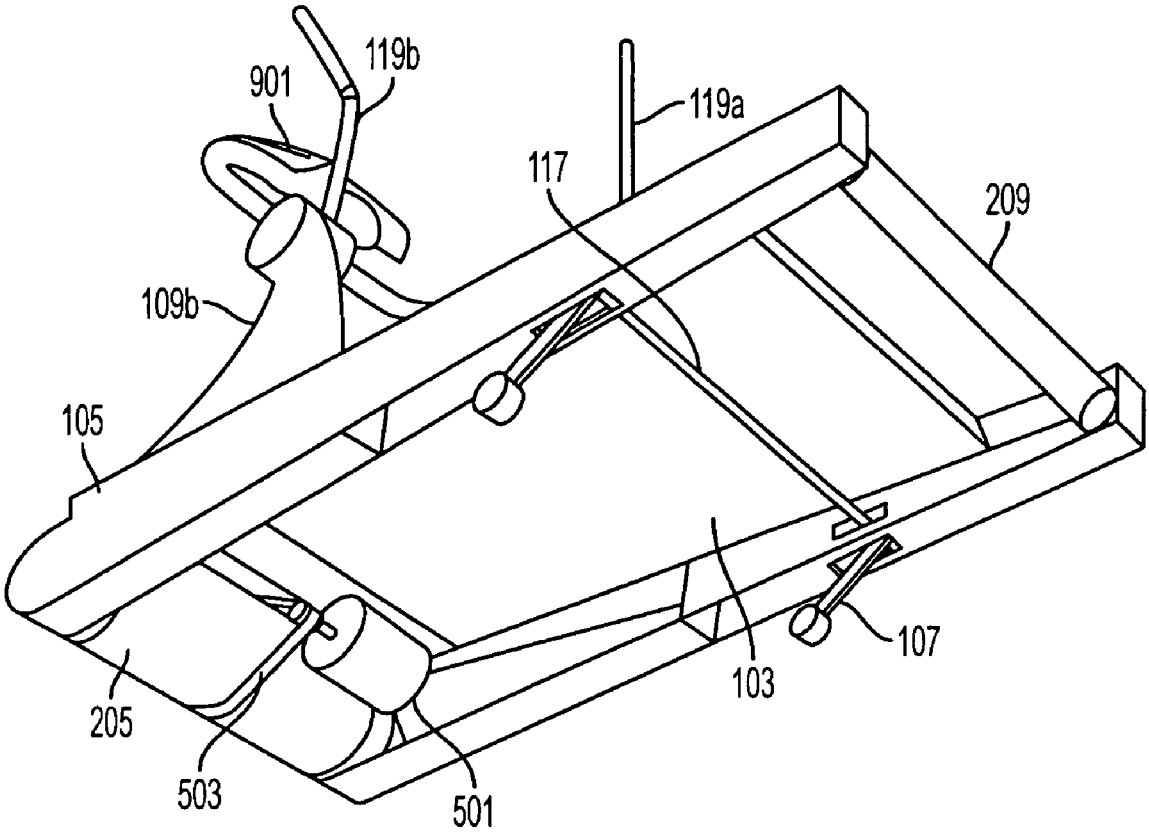
FIG. 4 is an underside perspective view of another embodiment of a treadmill with the belt removed to show the motor assist which, in this embodiment, is located under the support surface.
Figure 5:
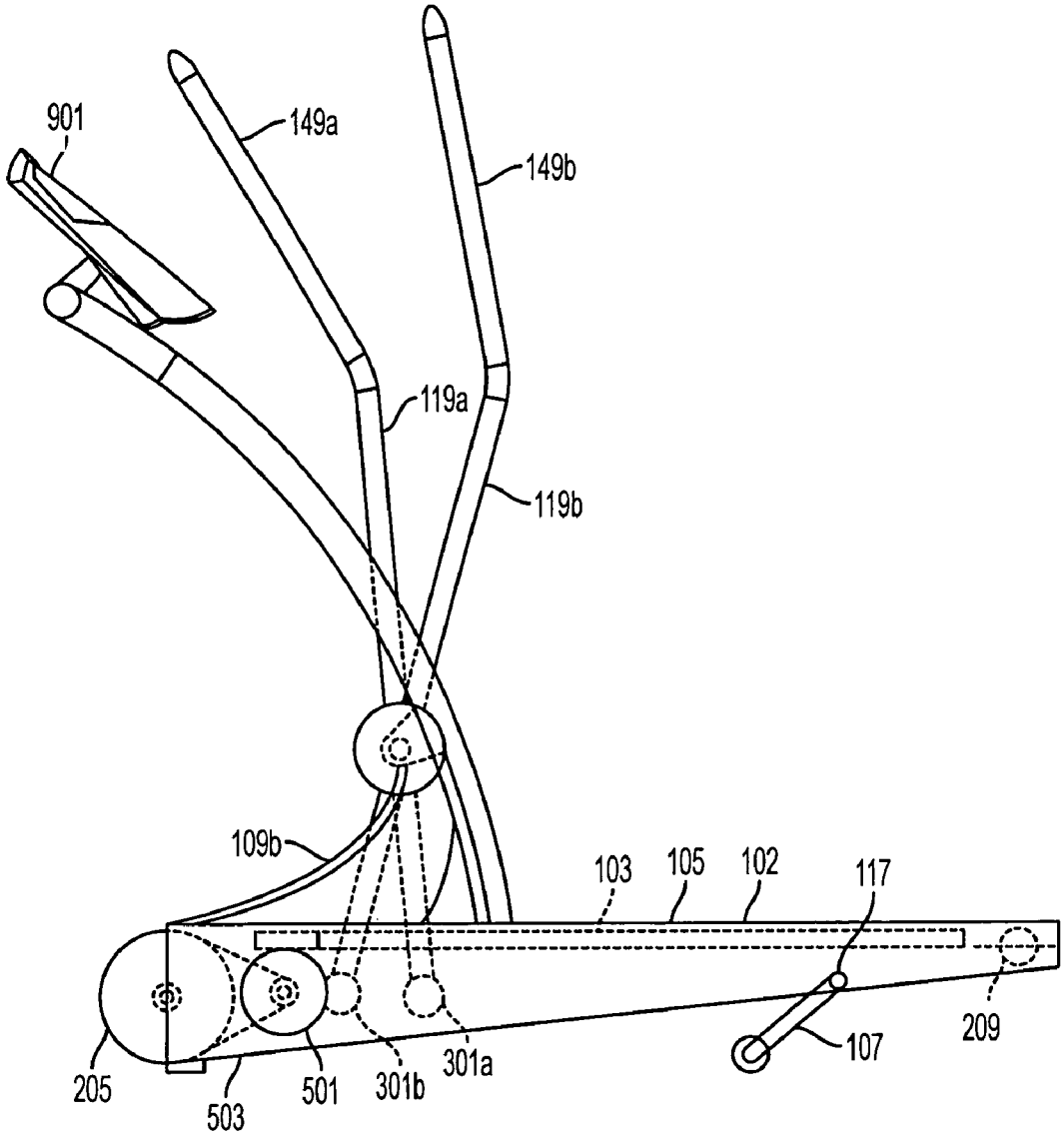
FIG. 5 is a side view of the embodiment of FIG. 4 showing hidden portions of the arms in two different positions.

Turning now to the drawings and referring first to FIGS. 1 through 3 which provide a first embodiment of a motor assisted arm powered treadmill (100) and the related embodiment of FIGS. 4 through 5. The treadmill (100) includes an endless belt (102) riding upon a support surface (103) and supported by a base (105). The support surface (103) will generally be a low friction support to eliminate as much friction as possible between the belt (102) and the support surface (103) created by the weight of the user pressing the belt into the support surface (103) when they stand on it. As shown in the drawings, the base (105) may be arranged so that the belt (102) is slightly elevated at the forward end of the base (105) with respect to its position at the rearward end of the base (105) making it inclined relative to a level horizontal surface on which the treadmill (100) would be placed. This provides that the support surface (103) rests in an inclined position by default. The surface upon which the treadmill (100) rests will generally be referred to as a "floor" in this document. If desired, the base may be arranged on an inclined floor, and in an alternative embodiment, the base (105) may be designed to place the support surface (103) generally parallel to the floor.

The incline of the support surface (103) relative to the floor is preferably variable during or before commencement of exercise by any suitable device, such as by providing manually or automatically adjustable feet or framing members, including pneumatic, hydraulic, or electromagnetic actuators, or motor-driven elevation systems. The elevation systems depicted in FIGS. 1 through 5 comprise two manually adjusted lift legs (107) which can serve to raise the rear of the base (105) by rotating about an axis of rotation (117) to extend from a position toward the rearward end of the base downward into the floor. The rotational motion of the lift legs (107) results in the rear of the support surface (103) being raised relative to the floor and therefore moving the support surface (103) to a position with a decreased incline such as is shown by comparing FIG. 2 to FIG. 3. In another embodiment, motor driven elevation systems such as those described in U.S. Pat. No. 5,462,504, the entire disclosure of which is herein incorporated by reference, could be used. In a still further embodiment, the rear of the device need not be lifted to go from incline to horizontal, instead the front may be lifted to go from horizontal to incline.

The treadmill (100) includes two generally upright arm supports (109*a*) and (109*b*) to which are rotationally attached right and left arms (119*a*) and (119*b*) at axes of rotation (139*a*) and (139*b*). Right and left are arbitrarily assigned in this description and are based from the perspective of the user when walking on the belt (102) in the preferred exercise direction. Also, for ease of understanding, components which have a symmetrical counterpart on an opposite side of the treadmill are numbered such that those on the right are denoted by the lower case letter "a" and those on the left by the lower case "b."

Rotational movement of the arm members (119*a*) and (119*b*) generally serves to provide the principal motivation force for moving the belt (102) in its endless path. This is performed by having the arm members (119*a*) and (119*b*) drive a drive cylinder (205) which in turn drives the belt. The arm members (119*a*) and (119*b*) are preferably of a length wherein a user can grasp an upper portion of them (149*a*) and (149*b*) which may be textured or surfaced to provide for a grip in a reasonably comfortable position when striding, and such that the user's arms and upper body are preferably exercised by movement thereof without overburdening any particular muscle group. As such, the arm members (119*a*) and (119*b*) may be adjustable in length or may have exaggerated grip locations to allow for a variety of grasping locations.

As best shown in FIGS. 1 through 3, the base (105) supports the support surface (103). The belt (102) in turn is arranged so as to rotate around two rollers. In this embodiment, the drive roller (205) is generally a larger roller located toward the front of the support while the idle roller (209) is located toward the rear but the relative sizes of the drive roller (205) and idle roller (209) may be reversed and the location of the two rollers (drive and idle) may also be reversed depending on embodiment. Because the belt (102) is generally flexible so as to be able to roll around the rollers (205) and (209), the belt (102) is supported on the user side of the support surface (103) by the support surface (103) which is generally fairly rigid. While the belt (102) is preferably tensioned around the two rollers (205) and (209), it would be understood by one of ordinary skill in the art that the tension will generally be insufficient to provide a good walking or running surface to the user, and therefore the belt (102) is allowed to move in close proximity to the support surface (103). Generally, the belt (102) will be pushed into the support surface (103) when the user is running or walking on the belt (102) as their weight will serve to push the belt (102) into the surface (103). Preferably, however, there is insufficient friction between the belt (102) and surface (103) to prevent the belt's (102) motion.

FIG. 1 provides the best view of an embodiment of the arm (119*a*) showing how the arm motion is used as the principle drive for the treadmill (100) by driving the drive roller (205) and in turn the belt (102). The movement of the arms (119*a*) and (119*b*) provide the principle source of power to the belt (102) via a transmission system (203) that rotates the belt (102) rearwardly as the arms (119*a*) and (119*b*) reciprocate. To this end, the reciprocating lower ends of the arms (119*a*) and (119*b*) wind and unwind a cable (201) in a transmission system (203) that rotates a forward drive roller (205) in a predetermined direction. As the drive roller (205) rotates, the belt (102), which is coupled thereto in a manner so as to not slip under ordinary loads, rotates rearwardly. The belt (102) may be arranged so as to not slip on the drive roller (205) by providing proper tensioning, by utilizing proper coefficients of friction, by having treads in the underside of the belt (102) which engage with counterpart treads (not shown) on the drive roller (205), or by any other method. The idle roller (209) is provided at the rear of the treadmill (100) to redirect the belt (102) forwardly under the support surface (103). As can be appreciated, the actual functions of the rollers (205) and (209) can be reversed. For example, the idle roller (209) can be mechanically arranged to function as the driving roller and the drive roller (205) can be arranged to act as an idle roller.

To discuss the drive mechanism, the mechanism on the left arm (119*b*) will be discussed as it is visible in FIG. 1. One of ordinary skill in the art would recognize, however, that the right arm (119*a*) will generally have similar structures thereon. To appropriately wind and unwind the cable (201), the transmission system (203) includes a pulley wheel (301*b*) coupled to lower ends of the left arm (119*b*). To this end, in the depicted embodiment, the left arm member (119*b*) includes a fork-shaped mounting (303*b*) for supporting the reciprocating pulley wheel (301*b*) between the forks thereof on an axle (305*b*). As best shown in FIG. 1, the cable (201) is fixed at the end thereof by a bolt or the like (307*b*) to the side of the base (105). As further shown, beginning at the end of the cable (201) where it is fixed to the left side of the base (105), the cable (201) is redirected around free-wheeling pulley wheel (301*b*) and in turn around a pulley wheel (311*b*) which is coupled to a drive roller axle (309) generally by a one-way clutch to rotate the drive roller (205). From the pulley wheel (311*b*), the cable (201) is redirected across the front of the treadmill (100) by rollers (313*a*) and (313*b*). In the depicted embodiment, the rollers (313*a*) and (313*b*) are disposed so that the cable (201) traverses the front of treadmill (100) slightly in front of the motor assist (501), and are thus preferably oriented at an angle to correspond with the angle of the cable (201) at that point.

From roller (313*a*), the right side of the cable (201) is treated in much the same way the left side was above. The cable (201) wound around a pulley wheel (not shown) similarly coupled to the opposite side of the axle (309) to rotate the drive roller (205). As can be appreciated, the right side of the treadmill (100) is arranged to be symmetrical to the left side, and is thus similarly engaged with right pulley wheel (not shown) before being fixed by bolt (not shown) to the right side of the base (105).

The ratio of the diameter of the drive roller (205) to the diameters of the various pulleys and the mechanical advantage obtained by the pulley winding ratio may be selected so that a normal length stride corresponds to a normal amount of arm movement for an average user.

So that the drive roller (205) is only driven by the arms (119*a*) and (119*b*) in one direction, the pulley wheel (311*b*) and its counterpart on the right side may include one-way bearings or a one way clutch. In addition, to ensure that the arms (119*a*) and (119*b*) reciprocate in opposing directions (e.g. one of arms (119*a*) and (119*b*) is moving forward while the other is moving backward), thus preventing the cable from having any excess slack, the arms (119*a*) and (119*b*) are preferably joined at their lower ends through a linkage (401). The linkage (401) is preferably pivotally connected to rearwardly extending rod (403*b*) on the left arm (119*b*) and its counterpart on the right arm (119*a*) which in turn are coupled to their respective arms (119*a*) and (119*b*) toward the bottom end thereof. The linkage (401) is connected at its center by a pin (405) or the like fixed with respect to the support surface (103) and allowing for pivotal (rotational) movement of the linkage (401). The pin (405) may be mounted to the underside of the support surface (103), or may be supported by a similar lower surface or by a transverse support bar (409) as shown. If the linkage (401) is longer than the width of the inner walls of the base (105), slots (407) or the like may be provided to facilitate movement of the linkage (401) ends.

The arm driving of the treadmill (100) will provide the principle drive mechanism for moving the belt (102) as the movement of the arms (119*a*) and (119*b*) by the user directly rotates the drive roller (205), but it does not provide the only drive mechanism. In particular, the arm driving will be supplemented by a motorized drive source called a motor assist device (501). The drive motion of the arms (119*a*) and (119*b*) will also be supplemented by the motion and weight of the user's feet in a direction parallel to the belt (102) which is not relied on but does effect the speed.

While the weight of the user is not principally used to propel the belt (102), it does have an effect in propelling the belt (102) which will be discussed. In particular, the effect is determined by the weight of the user in conjunction with the incline. With sufficient incline, the belt (102) will move freely without any arm movement as a result of the weight of the user and the gravitational interaction on the belt (102). So long as a sufficient component of the user's weight is directed along the movement direction of the belt (102) to overcome the frictional force of the user's weight in the direction perpendicular to the belt (into the support surface (103)) which creates friction, the belt (102) will rotate simply under the user's weight. The effect of the user's weight on the belt (102) may be compensated for by the motor assist device (501) as discussed later.

It should also be apparent that in a resting state, particularly when the belt (102) is not at an incline, there is a significant amount of force needed to start the belt (102) moving and the weight of the user will generally provide no benefit in this situation. Most of the starting force needs to be generated by the arm power as the weight will generally not help significantly (if at all) and the walking motion of the user will generally not serve to push the belt (102) in its endless loop, but will serve to propel the user off the front of the treadmill (100). This means that effectively to begin the exercise the user generates motion with the arms (119*a*) and (119*b*) to move their body mass on the belt (102) as they begin walking. They need to overcome the resting inertia of the system, which can be quite large.

In order to help the user overcome the resting inertia, and also to help power the belt (102) for users which do not have sufficient upper body strength to drive the belt (102) at their desired speed with arms (119*a*) and (119*b*), there is included in the treadmill (100) a motor assist device (501). The motor assist device (501) will generally be a small electric motor (often of less than 1 horsepower) which serves to further drive the belt (102) when the treadmill (100) is being used. Generally, the motor assist device (501) will directly move the belt (102) or will serve to rotate the drive cylinder (205) in the preferred direction under a source of power not generated by the user. The motor assist device (501), may be located at any location which is able to transfer motion generated by the motor assist device (501) to the belt (102) or drive cylinder (205) but, in the embodiment of FIGS. 1 to 3, is located in front of the drive roller (205), and in FIGS. 4 to 5 is located behind the drive roller (205) and underneath the support (103) so as to be generally hidden from view during operation. In a further embodiment, the motor assist device (501) may be incorporated into the drive roller (205) so that the drive roller (205) is directly driven. The transfer of drive from the motor assist device (501) to the belt (102) may be accomplished by any system or method known to those of ordinary skill in the art such as a transfer belt (503) or friction roller (505) or may be direct as discussed. It should be recognized that while the depicted embodiments of FIGS. 1 through 5 show the motor assist device (501) acting on the same cylinder that the arms (119*a*) and (119*b*) power, this is by no means required and the two drive sources (the arms (119*a*) and (119*b*) and motor assist device (501)) can operate on different cylinders (205) and (209).

It is important to recognize that the motor assist device (501) will serve as an assisting device, it will generally not be able to power the belt (102) in an exercise on its own. This means that the size of the motor in the motor assist device (501) can be dramatically reduced from the motors needed to power motorized treadmills which provides for weight and cost savings, while still providing the benefit to the user of the motorized assistance. In particular, the motor assist device (501) serves two specific functions in most embodiments. Firstly, the motor assist device (501) will provide for add-on force to help get the belt (102) moving and to overcome the resting inertia of the user on the belt (102), and secondly will provide an assisting force during the exercise to lower the minimum level of exercise the user is required to perform, particularly with their upper body.

In operation, the treadmill (100) will generally operate as follows. The principal power will be provided by the user pulling on one of the arm members (119*a*) or (119*b*) to move it toward them, they will generally push on the other of the arm members (119*a*) and (119*b*) moving it away from them. As this movement occurs, the cable (201) rotates the pulley wheels (301*b*), (311*b*), and their counterparts as it moves with the changing distances between the wheel (301*a*) and its counterpart as shown in FIG. 1, the rearward movement of the lower end of arm member (119*b*) rotates wheel (311*b*) in the desired clockwise direction (to drive the drive roller (205)), and thus the one-way bearings are arranged to impart this motion to the drive roller (205). Conversely, the forward movement of the arm (119*b*) rotates wheel (311*b*) in the counterclockwise direction, and thus the one-way bearings allow wheel (311*b*) to free-wheel at this time. As can be appreciated, the right side of the pulley system (200) works in a mirror image to the left side, i.e., increasing the distance between the right side pulleys pulling on right arm (119*b*) powers the drive roller (205), while the reverse movement has no effect. Even though one-way bearings are employed, at any time the amount of force required to move the arms (119*a*) and (119*b*) is generally substantially the same at both arms because the arms (119*a*) and (119*b*) are coupled together by the cable (201) and the linkage (401).

The drive of the arms (119*a*) and (119*b*) is assisted by drive from the user's lower body, their movement and weight, if relevant, and also by the motor assist device (501). The motor assist device (501) will help the user to drive the belt (102) with his/her upper body by providing an assistance level of drive to the drive roller (205). The amount of aid will generally be sufficient to reduce the amount of drive that needs to be provided by the user's upper body to a level acceptable to the user. Generally, this level will be the selected minimum exercise the user will perform with their upper body.

The motor assist device (501) will generally try to reach this minimum regardless of the arrangement of the treadmill (100). In particular, the motor assist device (501), in an embodiment, will supply more assistance when the incline is lower than when it is high. As discussed above, when the incline is high, the user's weight provides additional drive to the belt (102). The greater the incline of the belt (102) is at, the easier it is to move the belt (102) as the friction between the belt (102) and the support surface (103) is decreased and the user's weight provides additional assistance to move the belt (102) as it is a force directed parallel to the belt (102). Therefore at a higher incline the user will generally be forced to run faster than at a lower incline with the same or less arm drive.

At lower inclines, the weight of the user provides less to no aid, and the friction is increased, therefore the user generally moves slower. Therefore, if the belt (102) is more horizontal, additional force may be provided by the motor assist device (501). If the belt (102) is more inclined, the motor assist device (501) can provide less assistance. In this way the user can actually maintain a relatively constant speed through multiple inclines, which can allow for the incline to alter the workout difficulty in a more predictable fashion.

The exact amount of assistance provided by the motor assist device (501) may be chosen by a variety of different methods. In an embodiment, the assistance is simply a value chosen by the user prior to or during the exercise and is an absolute amount of drive imparted by the motor assist device (501). In this way, there is effectively more assistance at a higher incline than a lower incline as the motor assist device (501) provides a fixed level of assistance regardless of incline (and at a higher incline the user's weight provides additional assistance as discussed above). In another embodiment, the motor assist device (501) may provide a level of assistance based on the incline of the treadmill (100). This provides more consistency in the drive force which must be provided in the arms (119*a*) and (119*b*) to produce any given speed of belt (102) movement. In a still further embodiment, the level of assistance may be based on both the user's weight and the incline.

The user may input their weight into a control (such as computer control panel (901)) for the treadmill (100). The treadmill (100) may then use that value to compute the appropriate assistance for various levels of incline and control the motor assist device (501) to provide that assistance. In an alternative design, the motor assist (501) could determine the user's weight automatically, such as by powering up the motor assist device (501) when the user is standing on the belt (102) and computing their weight based on the torque used by the motor assist (501) to move the belt (102).

In the above, it should be clear that the motor assist device (501) serves to lower the minimum upper body exercise which needs to be performed for some, if not all, arrangements of the speed and incline of the belt (102). However, the motor assist device (501) is not intended to provide for motorized use of the treadmill (100).

The motor assist device (501) can also serve to provide exercise variations unavailable in motorless systems. In particular, in an embodiment, the motor assist (501) can provide for improved characteristics even at inclines above those where the motor is no longer needed to assist or at speeds above what the motor can provide. In particular, if the user wishes to push harder at high inclines without going faster, the motor assist device (501) may reverse direction, and instead of assisting the motion of the drive cylinder (205), it may resist it, allowing the user to have an extremely hard workout if desired and to eliminate the need for any type of frictional resistance mechanism, or other device to try and resist the motion of the belt (102).

Figure 6:
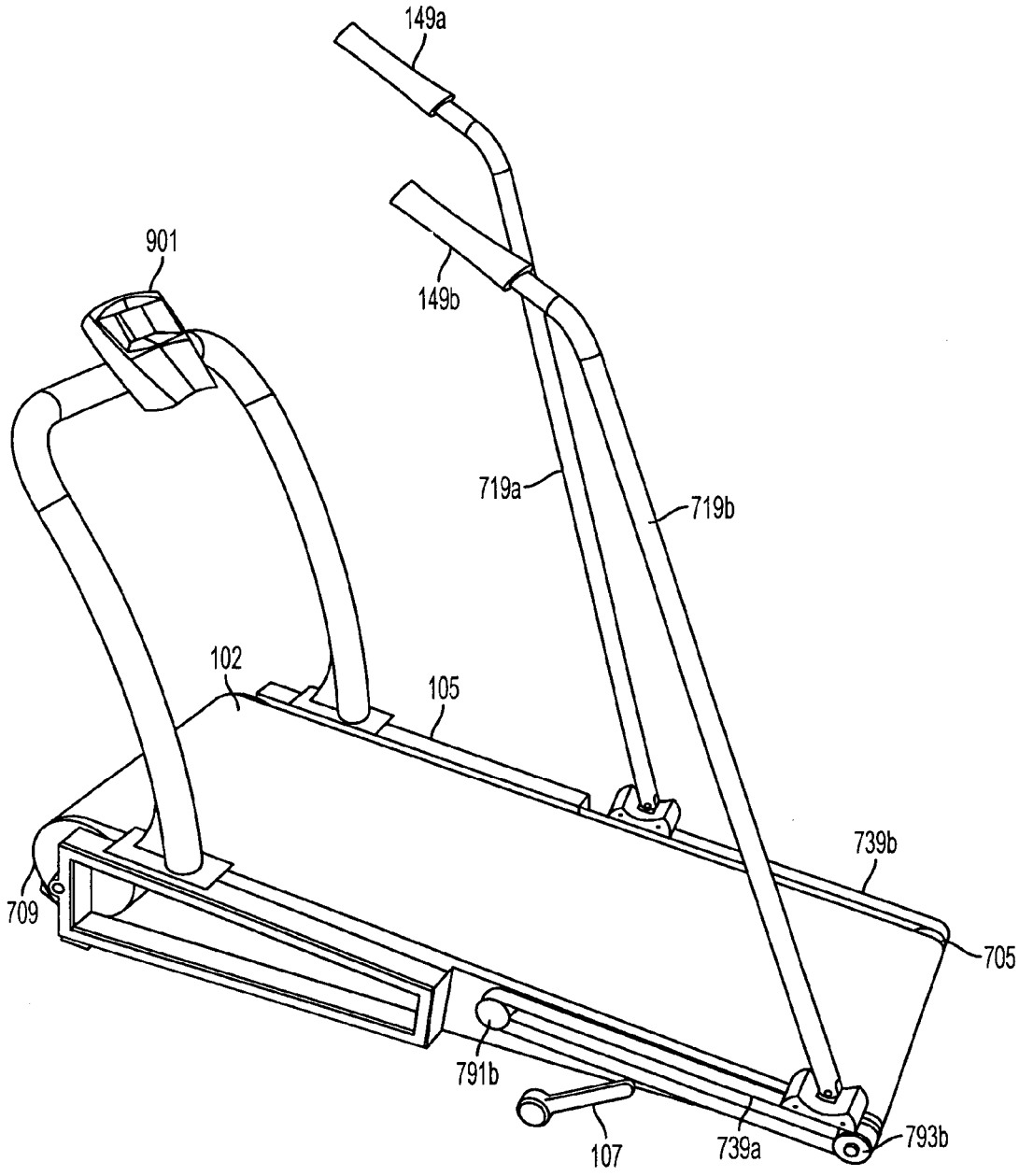
FIG. 6 is a perspective view of an embodiment of a treadmill having a dual arm arrangement where the arms utilize a sliding ski-like motion as opposed to a rotational motion.
Figure 7:
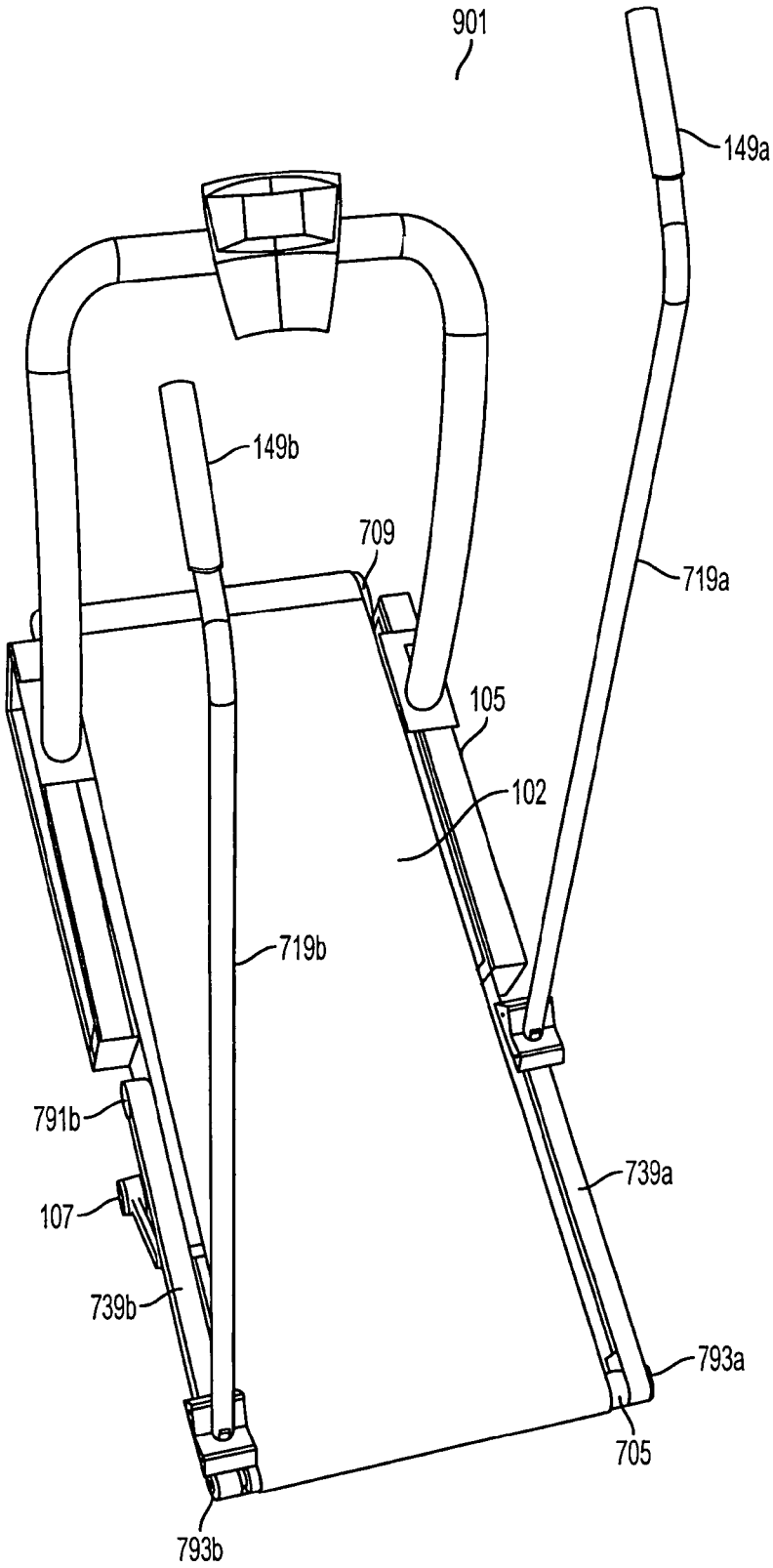
FIG. 7 is an overhead perspective view of the embodiment of FIG. 6.

FIGS. 6 and 7 provide for a slightly different embodiment of the arm power for a treadmill. In this embodiment, there is still a base (105) and belt (102) in similar arrangement. Lift legs (107) may also be included. The arms (719*a*) and (719*b*), however, are of different shape and do not rotate about an axis (139*a*) and (139*b*) relative to the base but instead the arms (719*a*) and (719*b*) move on the top surface of secondary belts (739*a*) and (739*b*) which run generally parallel to the top surface of belt (102) from a position generally half-way toward the front of the base (105) toward the rear of the base (105). This type of motion effectively replaces the rotation of the arms (119*a*) and (119*b*) in the previous embodiments, with a motion which is more of a linear sliding type of motion of arms (719*a*) and (719*b*). This linear sliding motion may generate similar drive force as that discussed in the prior embodiments by simply attaching the cable (201) to each of the arms (719*a*) and (719*b*) instead of to the base (105), eliminating the pulley (301*a*) and its corresponding pull on the right side, and having the arms (719*a*) and (719*b*) independently pull the cable (201) to and from around the pulleys on the drive roller (205).

In the embodiment depicted, however, the drive is accomplished using the rear roller as the drive roller. In particular, as the arm (719*b*) slides backwards, the associated secondary belt (739*b*) rotates about its two rollers (791*b*) and (793*b*). The roller (793*b*) is generally mounted on a one-way clutch or bearing similar to wheel (311*b*). Thus, the movement of the secondary belts (739*a*) and (739*b*) drives the rear roller (705). To provide for interlinked motion of the two arms (119*a*) and (119*b*), a link bar (401) system may again be used.

While this system is quite effective to provide for the motion, linear sliding motion may be provided by other methods. For instance, in alternative embodiments, the linear reciprocating motion may be accomplished by reciprocating motion in a constrained path such as, but not limited to, low friction sliding, or ball bearing paths. The embodiment of FIGS. 6 and 7 may also include a motor assist device (501) which may be located to drive either of the cylinders (705) or (709). In the depicted embodiment, the motor assist would generally be located under the support surface (103) as is discussed in conjunction with FIGS. 4 and 5.

While the above discusses a couple of different arm motions and related drive systems, in still additional embodiments, other alternative systems and methods may be used to transfer power to the drive roller from motion of the arms and regardless of the type of motion the arms make. In another embodiment, the arm members independently power the drive roller by having two non-connected gearing systems independently transfer the movement energy to the drive roller regardless of their motion. Alternatively, each arm may use a one way gear and toothed cable that provides for rotation in a singular direction. In a still further embodiment the transmission system may comprise any other system for converting the arms' movement to belt (102) rotation including, but not limited to, meshed gear arrangements, planetary gearing systems, hydraulic or pneumatic systems, or electromagnetic systems.

Also, although not necessary, in a still further embodiment, a braking device, generally a frictional resistance mechanism, may be added to further regulate the amount of force needed to be generated by the arms (119*a*) and (119*b*) to drive the belt (102), by providing an adjustable frictional force against movement of the belt (102).

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A treadmill comprising:

a frame;

an endless belt supported on said frame;

a support surface, said endless belt passing over said support surface;

an arm member being displaceable forwardly and rearwardly relative to the frame by a reciprocating arm movement of a user, said displacement providing a principal motivation force for imparting motion to rotate said endless belt in a first direction;

a drive roller coupled to said belt for imparting motion to said belt;

a transmission system linking said drive roller to said displaceable arm member; and a motor assist device coupled to said endless belt, wherein operation of said motor assist device will impart an assisting motivation force to rotate the endless belt in said first direction; and wherein said assisting motivation force alone is insufficient to power said endless belt when the user is on said endless belt.

2. The treadmill of claim 1 further comprising a second arm member being displaceable forwardly and rearwardly relative to the frame by a reciprocating arm movement of a user, the second arm mechanism also being linked to said transmission system.

3. The treadmill of claim 2 wherein the transmission system includes a pulley system.

4. The treadmill of claim 3 wherein the pulley system includes at least one drive pulley coupled to the drive roller for rotation thereof and at least one displaceable pulley coupled to one of said arm members for displacement thereby, and further comprising a cable connected between said pulleys such that displacement of the displaceable pulley is translated by the cable into rotation of the drive roller pulley.

5. The treadmill of claim 2 further comprising a linkage connecting the arm members.

6. The treadmill of claim 5 wherein the linkage couples the arm members for alternating, reciprocating movement.

7. The treadmill of claim 1 wherein, during an exercise, said user stands still at a point not on said endless belt and displaces said arm member.

8. The treadmill of claim 7 wherein the amount of motion imparted by said motor assist device can be altered during an exercise.

9. The treadmill of claim 8 wherein said amount of motion is selected based on a user's heart rate.

10. The treadmill of claim 8 wherein said amount of motion is preselected by a user prior to said exercise.

11. The treadmill of claim 1 wherein the amount of motion imparted by said motor assist device can be altered during an exercise.

12. The treadmill of claim 11 wherein said amount of motion is selected based on a user's heart rate.

13. The treadmill of claim 11 wherein said amount of motion is preselected by a user prior to said exercise.

14. The treadmill of claim 1 wherein said arm transmission system comprises a secondary belt and additional roller, said arm member causing said secondary belt to rotate on said additional roller and said drive roller.

15. The treadmill of claim 14 wherein said arm member moves in a substantially linear path.

16. The treadmill of claim 1 further comprising a computer control device.

17. The treadmill of claim 16 wherein said computer control device displays the amount of work performed by the upper body of a user.

18. The treadmill of claim 1 wherein said arm member in combination with the operation of said motor assist device together actuate said endless belt to start rotation in said first direction from a stationary position.

19. The treadmill of claim 1 wherein said motor assist device comprises a motor having 1 or less horsepower.

20. The treadmill of claim 1 wherein said motor assist device comprises an electric motor.

21. The treadmill of claim 1 wherein said motor assist device drives said drive roller.

22. The treadmill of claim 1 wherein said motor assist device is located under said support surface.

23. The treadmill of claim 1 wherein said motor assist device is located in front of said support surface.

24. The treadmill of claim 1 further comprising an elevation system for controllably adjusting the angle of inclination of the treadmill.

25. The treadmill of claim 1 wherein said arm member rotates about a point.

26. The treadmill of claim 1 wherein said motor assist device can be used to approximate the weight of a user.

27. The treadmill of claim 1 wherein said motor assist device can be used to approximate the strength of a user.

28. The treadmill of claim 1 wherein, during an exercise, said user walks on said endless belt and displaces said arm member.

29. The treadmill of claim 1 wherein, during an exercise, said user runs on said endless belt and displaces said arm member.

30. The treadmill of claim 1 wherein said motor assist device is part of said drive roller.

31. A method of driving the rotation of a treadmill belt, comprising the steps of:

inclining a front end of said belt such that gravitational force on a user frictionally coupled to said belt urges the belt rearwardly;

transferring kinetic energy, generated by a user moving an arm member functionally connected to said belt, to rearward movement of said belt to assist said gravitationally induced rearward movement of said belt; and mechanically assisting said gravitationally induced rearward movement of the belt using a motor assist device;

wherein said motor assist device alone is incapable of moving said belt when a user is on said belt.

32. The method of claim 31 further comprising the step of:

providing a drive roller connected to said belt for rearward rotation thereof;

wherein in the step of transferring, said arm members rotate a pulley which in turn rotates said drive roller rearwardly.

33. A treadmill comprising:

a frame;

an endless belt supported on said frame;

an arm member being displaceable forwardly and rearwardly relative to the frame by a reciprocating arm movement of a user said displacement providing a principal motivation force for imparting motion to rotate said endless belt in a first direction;

a drive roller coupled to said belt for imparting motion to said belt;

a transmission system linking said drive roller to said displaceable arm member; and a motor assist device coupled to said endless belt, so that operation of said motor assist device will impart an assisting motivation force to rotate said endless belt in a first direction;

wherein said motor assist device alone is incapable of moving said endless belt when the user is on said endless belt; and wherein an amount of said assisting motivation force is dependent on said user's weight.

34. The treadmill of claim 33 wherein at a time after said endless belt has been actuated, said motor assist device and said displacement of said arm members work together to impart motion to said endless belt.

35. The treadmill of claim 33 wherein at a time after said endless belt has been actuated, said motor assist device reverses direction of said assisting motivation force imparted to said endless belt to resist instead of assist said principal motivation force.

36. The treadmill of claim 33 wherein said amount of said assisting motivation force is also dependent on an incline of said endless belt.

* * * * *